US008308459B2

(12) United States Patent
Grann et al.

(10) Patent No.: US 8,308,459 B2
(45) Date of Patent: Nov. 13, 2012

(54) MOINEAU PUMP

(75) Inventors: Helge Grann, Bjerringbro (DK); Sebastien D'Antonio, Thorsø (DK)

(73) Assignee: Grundfos Management a/s, Bjerringbro (DK)

( * ) Notice: Subject to any disclaimer, the term of this patent is extended or adjusted under 35 U.S.C. 154(b) by 380 days.

(21) Appl. No.: 12/740,731

(22) PCT Filed: Sep. 25, 2008

(86) PCT No.: PCT/EP2008/008120

§ 371 (c)(1),
(2), (4) Date: Apr. 30, 2010

(87) PCT Pub. No.: WO2009/056200

PCT Pub. Date: May 7, 2009

(65) Prior Publication Data

US 2010/0260636 A1 Oct. 14, 2010

(30) Foreign Application Priority Data

Nov. 2, 2007 (EP) ..... 07021379

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/48; 418/49; 418/150

(58) Field of Classification Search ..... 418/5, 9, 418/48–50, 150, 166

See application file for complete search history.

(56) References Cited

U.S. PATENT DOCUMENTS

| | | | | |
|---|---|---|---|---|
| 1,892,217 | A | 12/1932 | Moineau | |
| 2,733,854 | A * | 2/1956 | Chang | 418/48 |
| 3,932,072 | A * | 1/1976 | Clark | 418/48 |
| 5,221,197 | A * | 6/1993 | Kochnev et al. | 418/48 |
| 5,407,337 | A * | 4/1995 | Appleby | 418/48 |
| 5,807,087 | A * | 9/1998 | Brandt et al. | 418/48 |

FOREIGN PATENT DOCUMENTS

| | | | |
|---|---|---|---|
| EP | 0 457 925 | A1 | 11/1991 |
| EP | 1503034 | A1 * | 2/2005 |
| GB | 436 843 | A | 10/1935 |

* cited by examiner

*Primary Examiner* — Theresa Trieu
(74) *Attorney, Agent, or Firm* — Panitch Schwarze Belisario & Nadel LLP

(57) ABSTRACT

A Moineau pump or Moineau compressor includes a conically designed inner (4) and a conically designed outer (8) element, whose longitudinal axes ($X_1$, $X_2$) run at an angle to one another and intersect at a point. The pump or compressor has at least two sections (2*a*, 2*b*, 2*c*, 2*d*) in the axial direction. A part (4*b*) of the inner element (4) located in a second section (2*b*) is arranged rotated with respect to a part (4*a*) of the inner element located in a first section (2*a*) about the longitudinal axis ($X_1$) of the inner element (4). A part (8*b*) of the outer element (8) located in the second section (2*b*) is arranged rotated with respect to an other part (8*a*) of the outer element (8) located in the first section (2*a*) about the longitudinal axis ($X_2$) of the outer element (8).

10 Claims, 6 Drawing Sheets

MOINEAU PUMP

CROSS-REFERENCE TO RELATED APPLICATIONS

This application is a Section 371 of International Application No. PCT/EP2008/008120, filed Sep. 25, 2008, which was published in the German language on May 7, 2009, under International Publication No. WO 2009/056200 A1 and the disclosure of which is incorporated herein by reference.

BACKGROUND OF THE INVENTION

The present invention relates to a Moineau pump or to an eccentric screw pump or eccentric screw compressor. Such Moineau pumps or eccentric screw pumps are known, for example, from U.S. Pat. No. 1,892,217. These pumps have an annular outer element and an inner element which is arranged in the inside of the outer element. The inner side of the outer element as well as the outer side of the inner element have a helical structure, wherein the structure of the outer element has one screw turn or winding or tooth more. The inner element moves in the inside of the outer element relative to this on an eccentric path, wherein the inner and/or the outer element may be moved for this.

A basic problem with Moineau pumps designed in a conical manner is the axial forces occurring in a pulsating manner. Here, great peak forces may occur, in particular with pumps for large delivery heads, which make it necessary to press the inner and outer element of the pump together with accordingly large axial forces. On the one hand the wear, but on the other hand also the starting moment for the drive of the pump, are increased on account of the increased friction.

BRIEF SUMMARY OF THE INVENTION

It is the object of the present invention to provide an improved Moineau pump or an improved Moineau compressor, with which the occurring axial forces are reduced and accordingly the friction and wear of the pump may be reduced. The above object is achieved by a Moineau pump with the features specified in the independent claim of the present application. Preferred embodiments are to be deduced from the dependent claims, the subsequent description as well as the attached figures.

The Moineau pump or the Moineau compressor, according to the present invention, has a conically designed inner and a conically designed outer element. Thereby, the inner element has a central conical recess. The outer element thereby is designed annularly in the known manner, and has a helical or spiral structure on its inner periphery. The inner element in a corresponding manner, is designed spirally or helically on its outer periphery, wherein the helical structure of the outer element has one tooth or thread turn more than the structure on the outer periphery of the inner element. The inner and the outer element are arranged to one another such that their respective longitudinal axis run at an angle to one another and intersect at a point.

According to the present invention, the pump is divided into at least two sections in the axial direction, i.e. in the delivery direction. Thereby, each section comprises a part of the outer element and a part of the inner element. The parts of the inner element and the parts of the outer element are arranged rotated to one another in the at least two sections. This means that the part of the inner element which is situated in the second section is rotated by a certain angular amount with respect to the part of the inner element which is situated in the first section. Accordingly, the part of the outer element which is situated in the second section is rotated by a certain angular amount about the longitudinal axis of the outer element with respect to the part of the outer element which is situated in the first section.

One succeeds in the axial force peaks in the sections not occurring at the same angular position of a drive shaft, or of the inner or outer element to one another, but rather in the axial force peaks in both sections occurring at different rotation angles, by way of the arrangement of the several sections or stages of the Moineau pump which are offset or rotated (twisted) in the rotation direction. The maximal occurring axial force is reduced in this manner, since the axial force peaks do not add at the same angular position. Rather, the course of the axial force over the rotation angle of the drive shaft with a rotated arrangement of the sections to one another is such that a larger number of axial force peaks occurs, but with a reduced amplitude. Thus, as a whole, a smoothed course of the axial force over the rotation angle is achieved. The total loading of the pump drive is reduced by way of this.

Furthermore, by way of the fact that the maximally occurring axial force is reduced, one only requires a low axial pressing force, in order to retain the outer and inner elements in bearing. In turn, the friction between the inner and the outer element is also reduced on account of this, by which means, on the one hand the wear, and on the other hand the required starting moment are reduced. The overall efficiency may be improved by way of this.

The pump preferably has more than two sections or stages, wherein then, in each case, in two sections adjacent to another, the part of the first inner element situated in the second section is arranged rotated about the longitudinal axis of the inner element with respect to the part of the inner element which is situated in a first section. Accordingly, the part of the outer element which is situated in the second section is arranged rotated about the longitudinal axis of the outer element with respect to the part of the outer element which is situated in the first section. Thus, with several sections or stages, all sections which in each case are adjacent one another, are preferably designed such that these form a first and second section, in which the outer and inner element are arranged rotated to one another as previously described. This means that with a pump with four sections, the outer and the inner element in the second section are rotated with respect to the inner and outer element in the first section, and then in turn, in the third section, the outer and inner element are rotated with respect to the outer and inner element in the second section. Accordingly, then in the fourth section, again the outer and inner element are rotated with respect to the outer and inner element in the third section. In the case of even more sections, this continues accordingly. Thereby, the rotation from section to section is preferably effected in the same rotational direction, so that as a whole all sections are rotated to one another, and no two sections are present, in which the outer and inner elements are arranged at the same angular alignment with respect to their longitudinal axis. This means that the angle about which the parts are rotated to one another, may be dependent on the number of sections, so that a rotation of the parts is smaller than 360° between the first and last section.

Further preferably, the parts of the inner element are rotated to one another by a different angular amount than the parts of the outer element. By way of this, a particularly smooth running of the pump may be achieved on account of the different number of thread turns on the inner and outer element.

Preferably, the helical contour on the outer periphery of the inner element has the same pitch in all four sections of the pump. Accordingly, it is preferable for the helical contour on the inner periphery of the outer element to have the same pitch in all sections of the pump. This means that the pitch of the thread is in each case constant over the whole pump from the inner to the outer element. Further preferably, the number of revolutions of the thread turns is the same in each section.

Usefully, the part of the inner element which is situated in the second section is rotated relative to the part of the inner element which is situated in the first section, by an angle:

$$\alpha = \frac{360}{n \times m}.$$

Accordingly, the part of the outer element which is situated in the second section is usefully rotated relative to the part of the outer element which is situated in the first section, by an angle:

$$\alpha = \frac{360}{n \times (m+1)}.$$

Thereby, "n" is the number of sections of the pump and "m" is the number of thread turns or teeth of the inner element. By way of the selection of the rotation angle according to these formulae, one ensures that an as uniform as possible force course may be achieved in dependence on the number of sections or stages of the pump. Moreover, thereby one takes into account of the fact that the thread structure of the outer element has one more thread turn or tooth than the thread structure of the inner element. The rotation angle of the outer and inner element is accordingly different for this reason Preferably, with two parts of the inner element which are adjacent to one another, these parts at the face-ends which are adjacent to one another, are in each case designed in a manner such that the largest cross-sectional area of the smaller part is situated completely within the smallest cross-sectional area of the larger part. In this manner, it is ensured that the smaller part does not project beyond the outer periphery of the adjacent larger part at any location.

With two parts of the inner element which are adjacent one another, these parts at the end-sides adjacent to one another are further preferably designed in a manner, such that the maximum radius at the end-side of the part situated in the second section is smaller than the minimal radius at the end-side of the part situated in the first section. By way of this design, it is ensured that no matter by what angle the two parts are rotated to one another with respect to their longitudinal axis, the end-side of the part situated in the first section does not extend beyond the periphery of the adjacent end-side of the part situated in the second section. It is thus possible to rotate the two parts to one another about any angle.

According to a further preferred embodiment of the present invention, a spacer element, e.g. a spacer disk, is arranged between two parts of the inner element which are adjacent to one another. The spacer element retains the two parts distanced to one another in the direction of the longitudinal axis. By way of this, one ensures that a part of the inner element of a first section does not collide or come into contact with a part of the outer element in a second section. This means that it is ensured that a part of the inner element always exclusively comes into contact with the associated part of the outer element. This is particularly important if the inner and outer element are movable to one another in the axial direction.

According to a particularly preferred embodiment of the present invention, the inner element is designed as one piece over at least two sections, preferably over all sections. This means, that the parts of the inner element which are situated in these two sections of the pump, are formed as one piece, for example of metal or ceramic. This simplifies the manufacture, since no assembly and alignment of several individual parts are required for forming the inner element.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. The invention is hereinafter described by way of example and by way of the attached figures.

There are shown in the drawings.

DETAILED DESCRIPTION OF THE INVENTION

Figure 1:
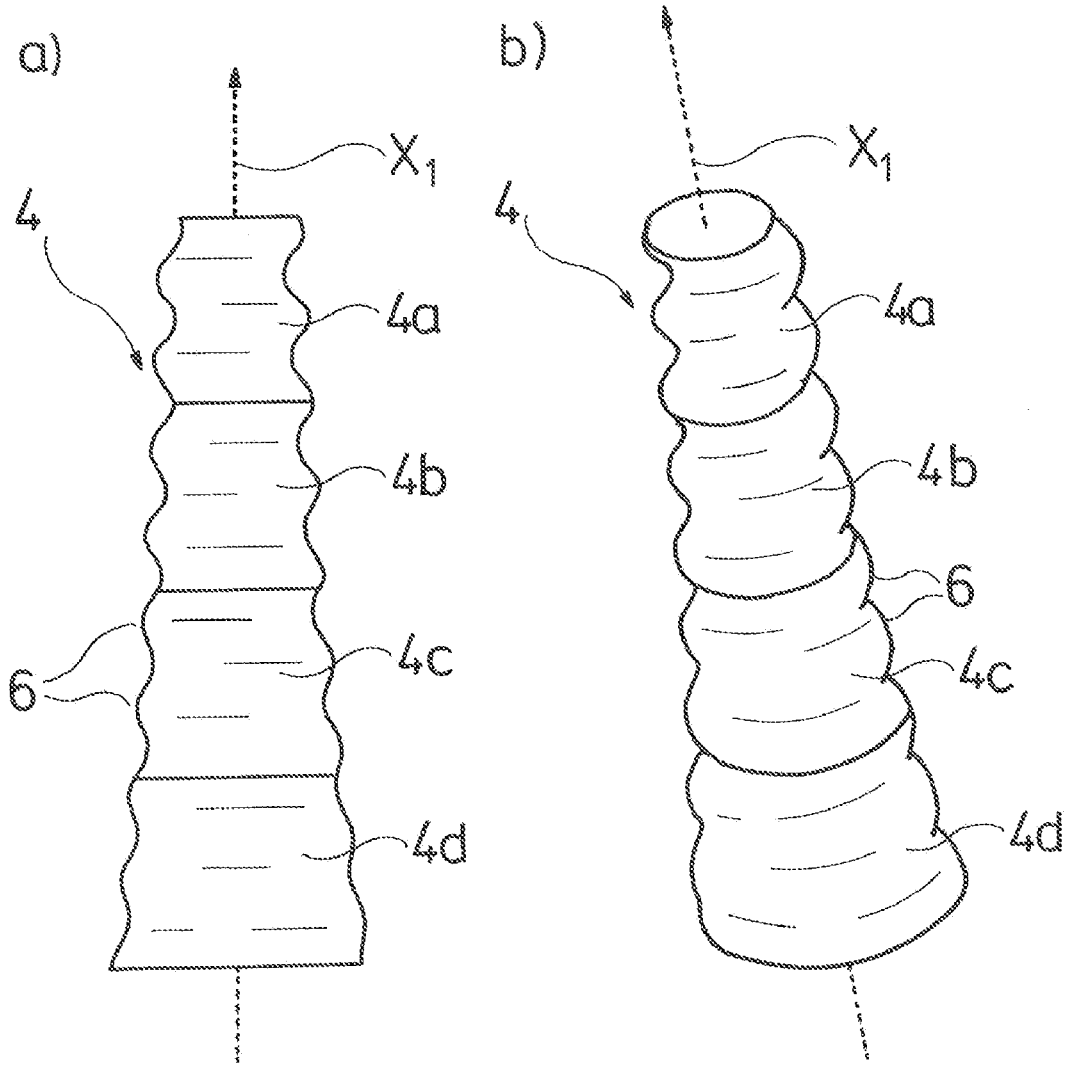
FIG. 1*a* is an elevation view of an inner element with four sections which are not rotated to one another in accordance with a preferred embodiment of the present invention.
FIG. 1*b* is a perspective view of the inner element shown in FIG. 1*a;*

Certain terminology is used in the following description for convenience only and is not limiting. The words "inner" and "outer" refer to directions toward and away from, respectively, the geometric center of the device, and designated parts thereof, in accordance with the present invention. The words "first" and "second" designate an order or operations in the drawings to which reference is made, but do not limit these steps to the exact order described. Unless specifically set forth herein, the terms "a," "an" and "the" are not limited to one element, but instead should be read as meaning "at least one." The terminology includes the words noted above, derivatives thereof and words of similar import.

Figure 2:
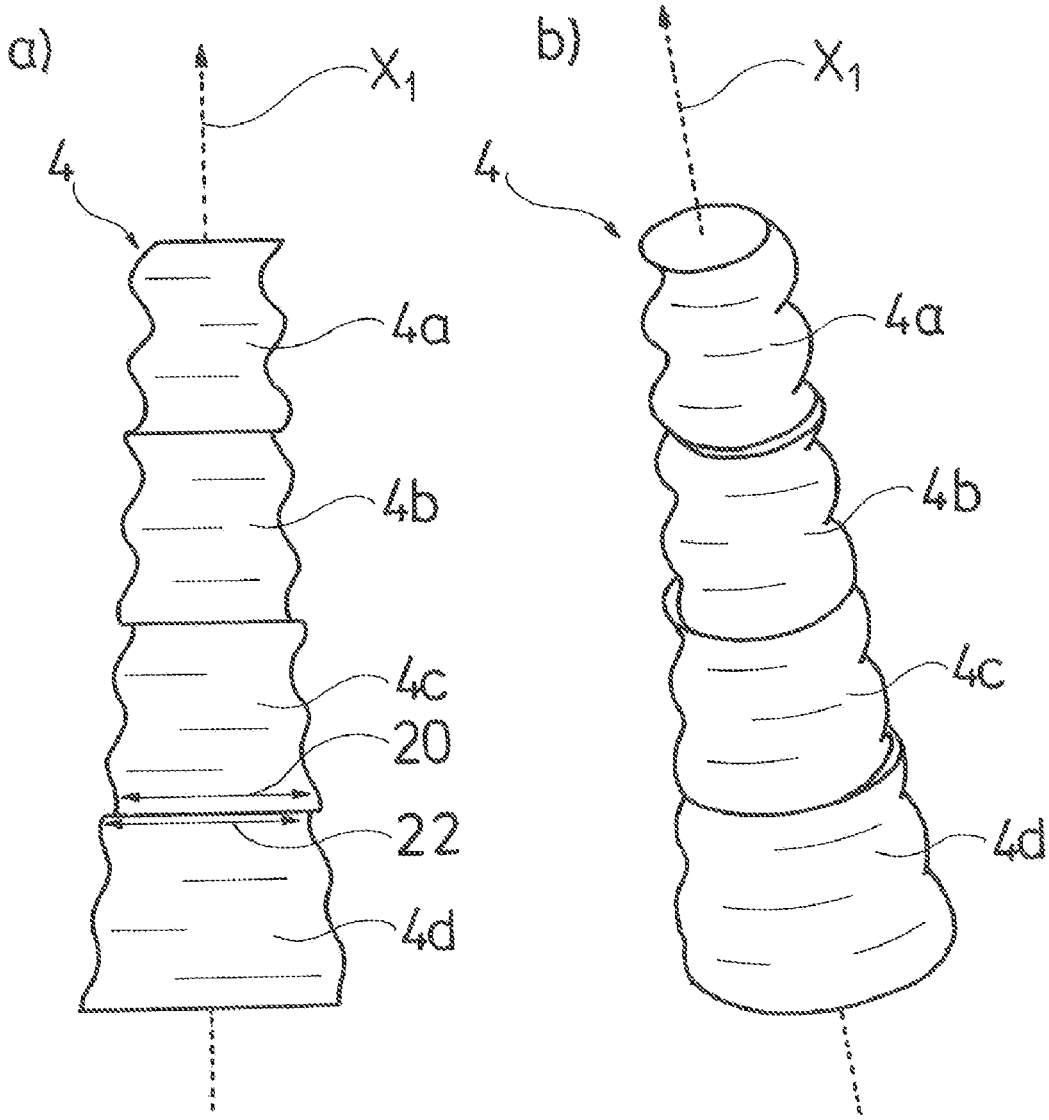
FIG. 2*a* is an elevation view of an inner element with four sections which are rotated to one another in accordance with another preferred embodiment of the present invention.
FIG. 2*b* is a perspective view of the inner element shown in FIG. 2*a;*
Figure 3:
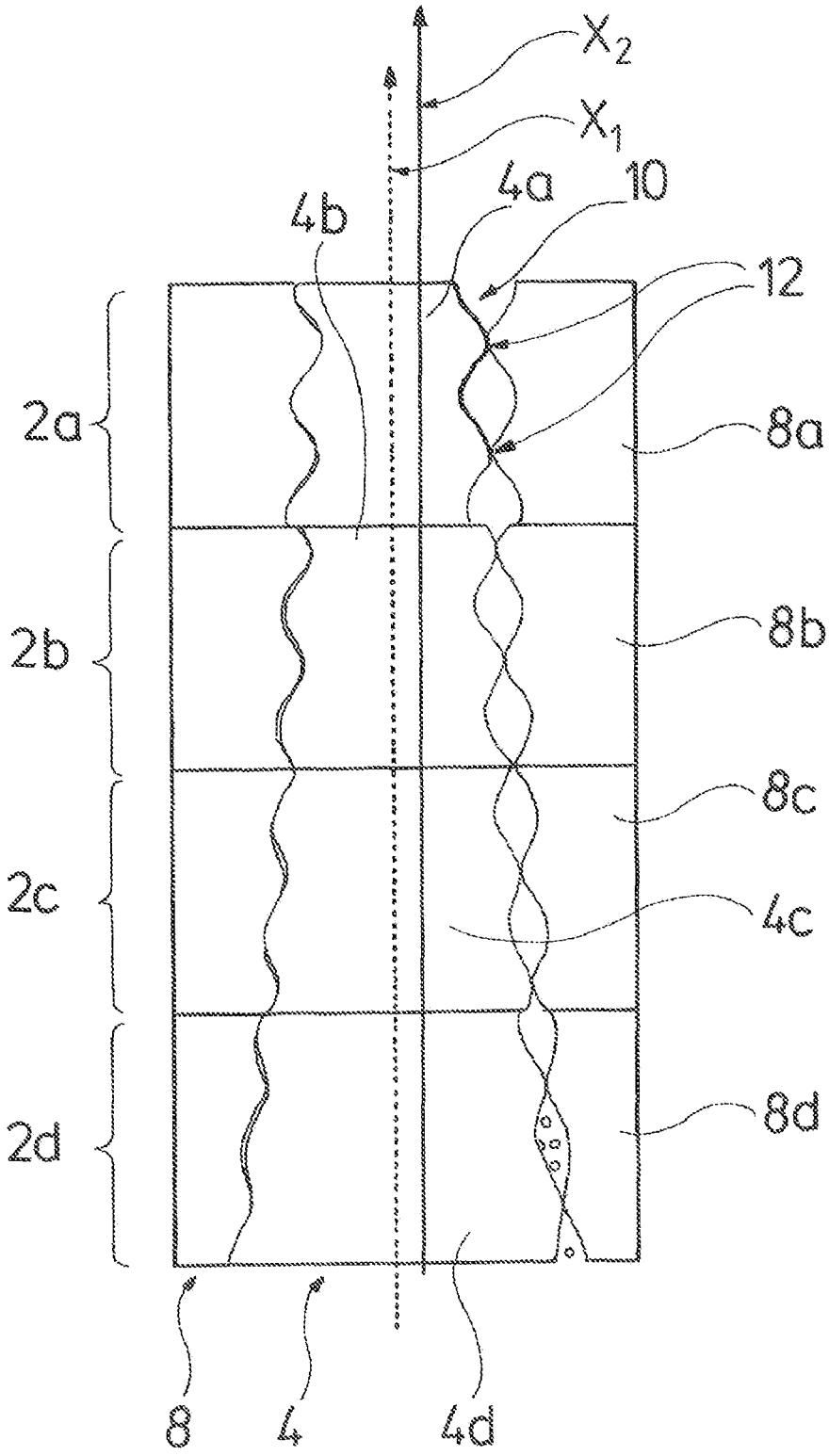
FIG. 3 is a schematic sectioned view of an inner element shown in FIGS. 2*a* and 2*b* inserted into an outer element.

Referring to the drawings in detail, wherein like numerals indicate like elements throughout, there is shown in FIG. 2*a* a lateral or elevation view and FIG. 2*b* a perspective view of an inner element of a Moineau pump according to a preferred embodiment of the present invention. According to this preferred embodiment example, the pump is preferably divided into four sections which are arranged one behind the other in the axial direction, i.e. in the longitudinal direction or delivery direction of the pump (FIG. 3).

The inner element 4 is accordingly preferably divided into four parts 4*a*, 4*b*, 4*c* and 4*d*, wherein the part 4*a* is arranged in the section 2*a*, the part 4*b* in the section 2*b*, the part 4*c* in the section 2*c*, and the part 4*d* in the section 2*d* of the pump. The shape of the inner element according to FIGS. 2*a*, 2*b* and 3 results proceeding from an inner element, as is shown in FIGS. 1*a* and 1*b*. Thereby, the inner element 4 with its four parts 4*a* to 4*d* arranged one behind the other in the axial direction $X_1$, are shown without a rotation between these parts in FIGS. 1*a* and 1*b*. In this condition, the outer periphery of the inner element 4 has a continuous helical or spiral structure. The screw turn or turns 6 as a continuous helix, run over the entire axial length $X_1$ of the inner element 4, i.e. continuously over the four parts 4*a* to 4*b*. Furthermore, one may recognize that the inner element 4 has a conical shape, i.e. proceeding from the axial end at the part 4*b*, tapers to the opposite axial end at the end of the part 4*a*.

Now, proceeding from this basic configuration shown in FIGS. 1*a* and 1*b*, according to a preferred embodiment of the present invention the parts 4*a* to 4*d* are now designed or arranged to one another, such that in each case they are rotated relative to one another about the longitudinal axis $X_1$ of the inner element 4. Thereby, starting from the condition according to FIGS. 1*a* and 1*b*, the part 4*c* is rotated relative with respect to the part 4*d*, the part 4*b* relative to the part 4*c*, and the part 4*c* relative to the part 4*b*, in each case by the same angle in the same rotational direction, about the longitudinal axis $X_1$. The rotational angle α between in each case two parts 4*a*, 4*b*, 4*c*, 4*d* thereby is:

$$\alpha = \frac{360}{4 \times m}.$$

wherein "m" is the number of thread turns or teeth. This means that in the case that the inner element 4 has one thread turn on its outer periphery, the parts 4*a*, 4*b*, 4*c*, 4*d* would in each case be rotated by 90° to the adjacent parts, i.e. the part 4*c* is rotated by 90° about the longitudinal axis $X_1$ relative to the part 4*d*. The part 4*b* in turn is rotated by 90° relative to the part 4*c*, and accordingly the part 4*a* by 90° relative to the part 4*b*. Thus results the shape of the inner element 4 which is shown in FIGS. 2*a* and 2*b*. Thereby, it is to be understood that the parts 4*a*-4*d* do not need to be manufactured and assembled as individual parts, but rather the whole element 4, as is shown in FIGS. 2*a* and 2*b*, may also be manufactured as one piece in a direct manner in the shape shown there. With regard to the embodiment shown in FIGS. 2*a* and 2*b*, the end-sides of the parts 4*a* to 4*d* which are adjacent to one another, each have the same diameter. This means for example that the diameter 22 of the part 4*d* at its side facing the part 4*c* is equal to the diameter 20 of the part 4*c* at its side facing the part 4*d*.

The outer element 8 is also preferably subdivided into four parts 8*a*, 8*b*, 8*c*, 8*d* according to the division of the inner element 4 according to the sections 2*a* to 2*d*, wherein the part 8*a* is situated in the section 2*c*, the part 8*b* in the section 2*b*, the part 8*c* in the section 2*c* and the part 8*d* in the section 2*d* of the pump. This means that the part 4*a* of the inner element 4 rotates in the part 8*a* of the outer element 8. Accordingly, the part 4*b* rotates in the part 8*b*, etc.

The outer element 8 is designed annularly in the known manner, and comprises a recess 10 in its inside, into which the inner element 4 is inserted. The recess 10 is shaped accordingly conically to the inner element 4 and on its inner periphery has a helical structure with screw turns 12. Thereby, one screw turn more is provided on the inner periphery of the recess 10 than on the outer periphery of the outer element 4, i.e. the outer element 8 has three thread turns on its inner periphery in the case that the inner element 4 has two thread turns.

The arrangement of the parts 8*a* to 8*d* of the outer element 8, proceeding from the outer element 8, is likewise formed with continuous thread turns from one axial end to the opposite axial end of the outer element 8. Thereby, the parts 8*a* to 8*d* are in each case rotated to one another about the longitudinal axis $X_2$ of the outer element 8. The longitudinal axis $X_2$ of the outer element runs inclined, i.e. at an angle to the longitudinal axis $X_1$ of the inner element. Both axes $X_1$, $X_2$ intersect at a point in the known manner.

The part 8*c* of the outer element 8 is arranged or formed rotated by a certain angle about the longitudinal axis $X_2$ with respect to the part 8*d*, and accordingly the part 8*b* relative to the part 8*c* by the same angle about the longitudinal axis $X_2$, as well as the part 8*a* relative to the part 8*b* likewise about the same angle about the longitudinal axis $X_2$. Thereby, the rotational direction of the rotation between the individual parts is the same in each case. The angle about which in each case two parts of the outer element 8 adjacent to one another are in each case rotated to one another, is:

$$\alpha = \frac{360}{4 \times (m+1)}.$$

wherein "m" is the number of the screw turns or teeth of the inner element. This means that starting from the example in which the inner element 4 has one screw turn, the rotation angle between the parts of the outer element 8 adjacent one another would in each case be 45° with the pump shown here.

As with the parts of the inner element 4, the parts 8*a* to 8*d* of the outer element 8 may be manufactured as individual parts, which are then assembled correspondingly rotated to one another. It is also possible to design the parts as one piece directly in the rotated arrangement.

Figure 4:
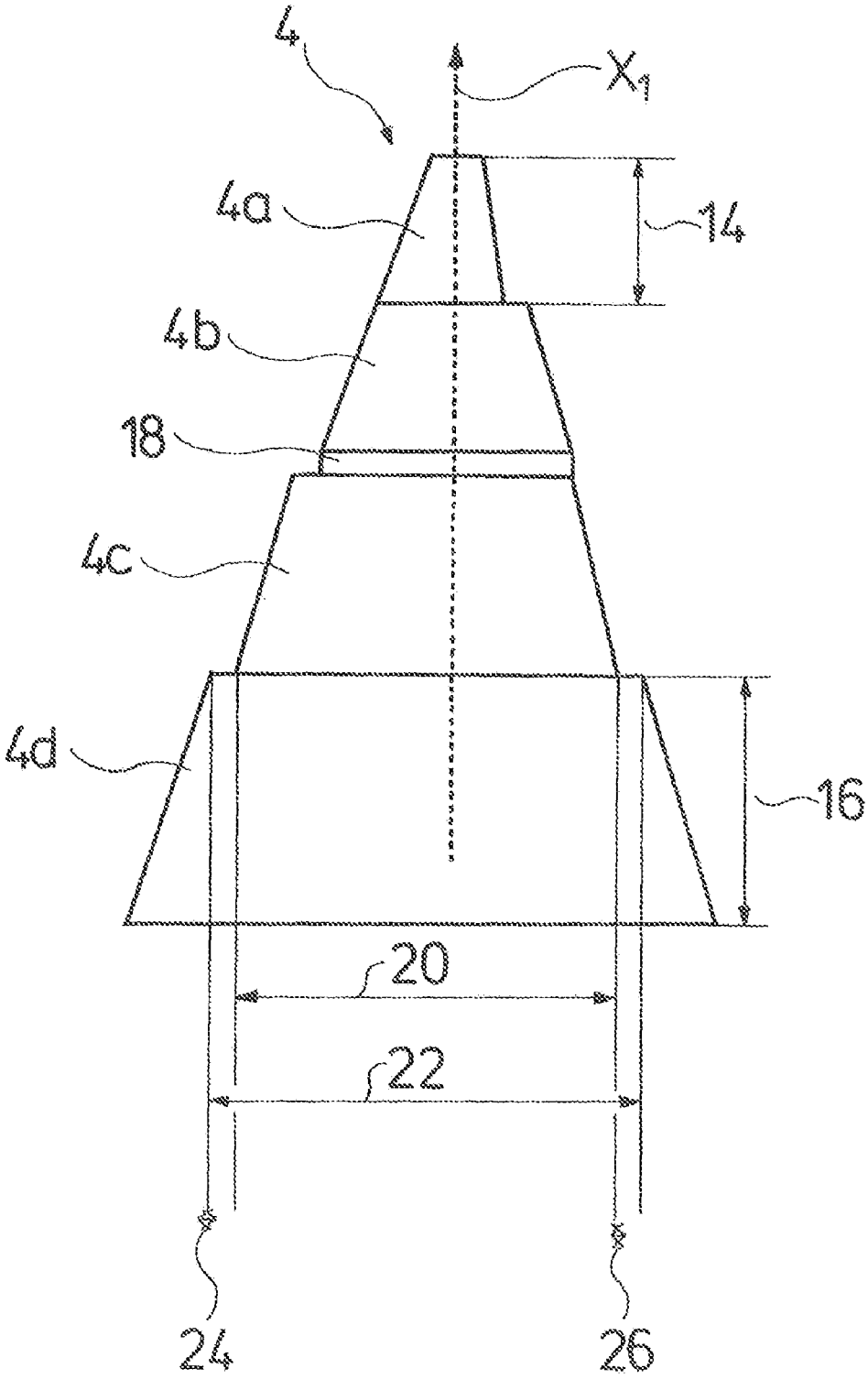
FIG. 4 is a schematic elevation view of an inner element in accordance with another preferred embodiment of the present invention.

FIG. 4 schematically shows an inner element 4 consisting of four parts 4*a*, 4*b*, 4*c*, 4*d*, wherein different embodiment examples are combined with one another on this arrangement solely for explanation. Thus, as is shown here, it is possible for the parts 4*a*, 4*b*, 4*c*, 4*d* to have different heights 14, 16 in the direction of the longitudinal axis $X_1$. It is to be understood that this is not limited only to the parts 4*a*-4*d*. The parts 4*d* and/or 4*c* may have different heights.

The arrangement of a cylindrical spacer disk 18 is shown for example between the parts 4*b* and 4*c*. Such a spacer disk could also be arranged between the sections 4*a* and 4*b*, as well as the parts 4*c* and 4*d*.

Furthermore, a further preferred design is schematically shown in FIG. 4 between the parts 4*c* and 4*d*. Indeed, specifically the part 4*c* at its axial end which faces the part 4*d* has a diameter 20, which in each direction is smaller than the diameter 22 at the axial end of the part 4*d* which faces the part 4*c*. In this manner, one ensures that no matter by which angle the part 4*c* is rotated about the longitudinal axis $X_1$ with respect to the part 4*d*, the part 4*c* does not project in the radial direction beyond the outer periphery of the part 4*d* at its face-end facing the part 4*c*. This means that the radial distance 24, 26 between the outer periphery of the part 4*c* at its end-side with the largest cross-sectional area and the outer periphery of the part 4*d* at its end-face with the smaller cross-sectional area, is larger or equal to 0 over the whole periphery, but is not smaller than 0. It is to be understood that the transition between the parts 4*c* and 4*b* and/or the part 4*d* and the part 4*a* may also be designed accordingly. By way of these designs, it is ensured that the parts of the inner element 4 at the interfaces between the individual parts do not collide in an undesirable manner with the wrong, i.e. non-allocated parts of the outer element 8. For example, it is ensured that the inner part 4*c* may not come into contact with the part 8*d* of the outer element 8, and accordingly the part 4*d* of the inner element 4 may not come into contact with the part 8*c* of the outer element 8. This is particularly important because the inner element 4 may be movable in the axial direction $X_1$ in the outer element 8 by a certain play, in order to vary the pressing force between the inner element and the outer element 8.

One achieves an optimal course of the axial force over a revolution between the inner element 4 and the outer element 8 by way of the inventive design with the sections 2*a* to 2*d* of the pump or parts 4*a* to 4*d* of the inner element 4 and the parts 8*a* to 8*d* of the outer element 8 being rotated to one another. The above is explained by way of the FIGS. 5 and 6.

Figure 5:
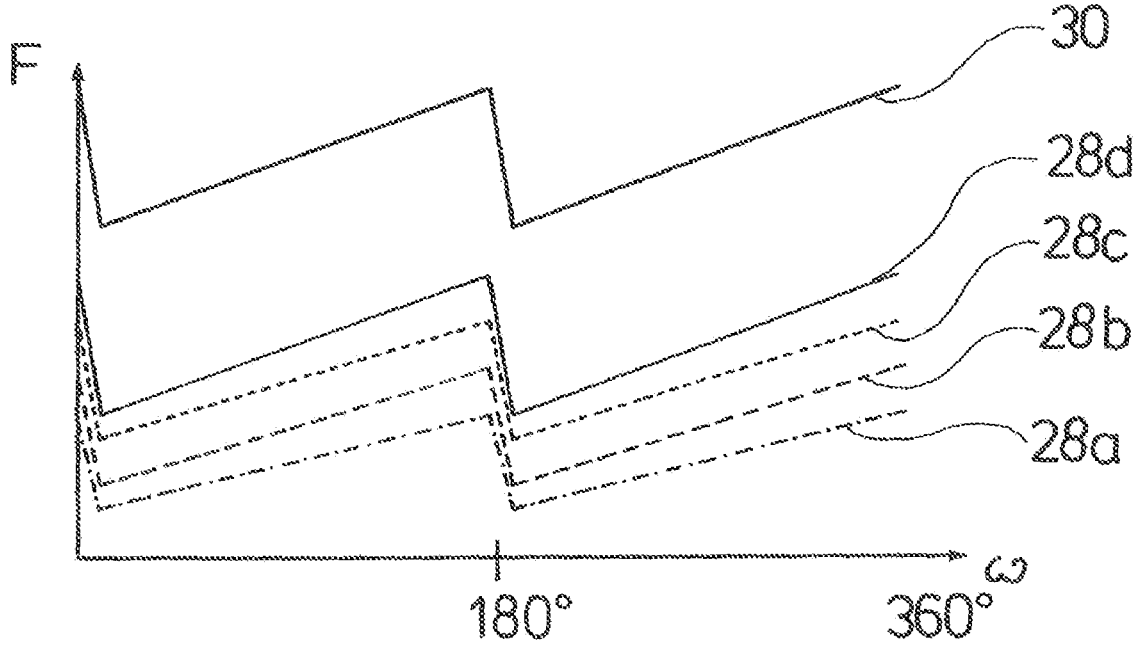
FIG. 5 is an axial force course for the inner element shown FIGS. 1*a* and 1*b*.

FIG. 5 firstly shows the axial force which acts between the inner element 4 and the outer element 8, when the parts 4*a* to 4*d* and accordingly the parts 8*a* to 8*d* are not rotated to one another, i.e. the pump has a design according to FIG. 1. In the diagram according to FIG. 5, the axial force is plotted against the rotation angle ω Thereby, the individual curves 28*a*-28*d* are shown, which correspond to the forces acting on the individual parts 4*a*, 4*b*, 4*c*, 4*d* of the inner element 4. The curve 30 shows the total force which acts onto the inner element 4 or between the inner 4 and outer element 8. It is to be recognized that the peaks, i.e. the occurring maximal forces, all occur at the same angle, here at about 180°, with the saw-tooth course of the force curves 28*a* to 28*d*. This leads to a large total force 30 occurring at this angle here.

Figure 6:
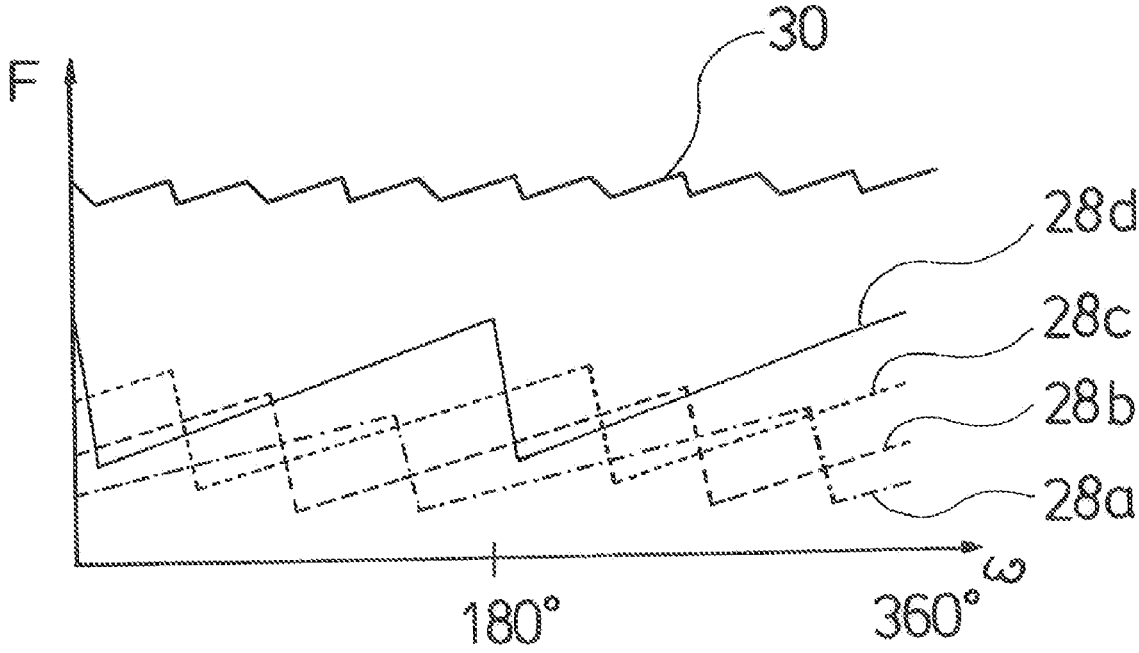
FIG. 6 is the axial force course of a pump in accordance with a preferred embodiment of the present invention.

FIG. 6 shows a corresponding diagram for the arrangement according to FIG. 3, with which the parts 4*a*-4*d* of the inner element, and accordingly the parts 8*a* to 8*d* of the outer element 8, are rotated to one another in the previously explained manner. One may recognise that the courses 28*a*-28*d* of the axial forces acting on the individual parts 4*a*-4*d* are also shifted to one another by a corresponding angle by way of this. This means that the force peaks or maximal forces which act on the individual parts of the inner element 4, no longer occur all at the same rotation angle ω, but offset by a corresponding angle. The effect of this is that a total force 30 is achieved, which although having a greater number of amplitudes, i.e. a higher frequency of the impacts, the individual amplitudes are however significantly smaller than with an arrangement of the sections of the pump which is not rotated. The occurring total axial force, i.e. the maximal axial force is also significantly lower.

The mentioned axial forces are those axial forces which act by way of the fluid pressure in the inside of the pump between the inner element 4 and the outer element 8. This means that corresponding forces must be exerted from the outside, in order to retain the inner element 4 bearing on the outer element 8. This pressure force may be reduced due to the fact that the force peaks are reduced and the total force is reduced, by which means the friction and wear in the inside of the pump are reduced.

If beforehand, the present invention has been described by way of a four-stage pump, which is to say a pump with four sections 2*a*-2*d*, it is however to be understood that the present invention may also be realized with other numbers of sections or stages, for example, less or more than four steps.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A Moineau pump or Moineau compressor comprising a conically designed inner element (4) and a conically designed outer element (8), whose longitudinal axes ($X_1$, $X_2$) run at an angle to one another and intersect at a point, wherein the pump or compressor includes at least two sections (2*a*, 2*b*, 2*c*, 2*d*) in the axial direction, wherein a part (4*b*) of the inner element (4) located in a second section (2*b*) is arranged rotated with respect to a part (4*a*) of the inner element located in a first section (2*a*) about the longitudinal axis ($X_1$) of the inner element (4), and a part (8*b*) of the outer element (8) located in the second section (2*b*) is arranged rotated with respect to a part (8*a*) of the outer element (8) located in the first section (2*a*) about the longitudinal axis ($X_2$) of the outer element (8).

2. A Moineau pump or Moineau compressor according to claim 1, wherein the pump or compressor comprises more than two sections (2*a*-2*d*), wherein in two sections (2*a*, 2*b*) adjacent to one another the part (4*b*) of the inner element (4) located in the second section (2*b*) is arranged rotated with respect to the part (4*a*) of the inner element located in the first section (2*a*) about the longitudinal axis ($X_1$) of the inner element.

3. A Moineau pump or Moineau compressor according to claim 1, wherein the parts (4*a*-4*d*) of the inner element (4) are rotated to one another by a different angular magnitude than the parts (8*a*-8*d*) of the outer element (8).

4. A Moineau pump or Moineau compressor according to claim 1, wherein a helical contour (6) on an outer periphery of the inner element (4) has the same pitch in all sections (2*a*-*d*) of the pump or compressor.

5. A Moineau pump or Moineau compressor according to claim 1, wherein a helical contour on an inner periphery of the outer element (8) has the same pitch in all sections (2*a*-2*d*) of the pump.

6. A Moineau pump or Moineau compressor according to claim 1, wherein the part (4*b*) of the inner element (4) located in the second section (2*b*) is rotated relative to the part (4*a*) of the inner element (4) located in the first section (2*a*) by an angle:

$$\alpha = \frac{360}{n \times m}, \text{ and,}$$

the part (8*b*) of the outer element (8) located in the second section (2*b*) is rotated relative to the other part (8*a*) of the outer element (8) located in the first section (2*a*) by an angle:

$$\alpha = \frac{360}{n \times (m+1)},$$

wherein "n" is the number of sections (2*a*-2*d*) of the pump, and "m" is the number of thread turns (6) of the inner element.

7. A Moineau pump or Moineau compressor according to claim 1, wherein adjacent ends of two parts (4*c*-4*d*) of the inner element (4) adjacent to one another are designed such that the largest cross-sectional area of the smaller part is situated completely within the smallest cross-sectional area of the larger part.

8. A Moineau pump or Moineau compressor according to claim 1, wherein adjacent ends of two parts (4i c-4*d*) of the inner element (4) adjacent to one another are designed such that a maximal radius (20) at an end-side of a part (4*c*) situated in one of the sections (2*a*, 2*b*, 2*c*, 2*d*) is smaller than a minimal radius (22) at an end-side of a part (4*d*) situated in another one of the sections (2*a*, 2*b*, 2*c*, 2*d*).

9. A Moineau pump or Moineau compressor according to claim 1, wherein a spacer element (18), which keeps the two parts (4*b*, 4*c*) distanced in the direction of the longitudinal axis ($X_1$), is arranged between two adjacent parts (4*b*, 4*c*) of the inner element (4).

10. A Moineau pump or Moineau compressor according to claim 1, wherein the inner element (4) is designed as one piece over the at least two sections (2*a*-2*d*).

* * * * *